US010428607B2

(12) United States Patent
Zhou

(10) Patent No.: US 10,428,607 B2
(45) Date of Patent: Oct. 1, 2019

(54) REVERSE CIRCULATION WELL TOOL

(71) Applicant: Saudi Arabian Oil Company, Dhahran (SA)

(72) Inventor: Shaohua Zhou, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 735 days.

(21) Appl. No.: 15/010,364

(22) Filed: Jan. 29, 2016

(65) Prior Publication Data

US 2017/0218710 A1 Aug. 3, 2017

(51) Int. Cl.

| | |
|---|---|
| ***E21B 33/12*** | (2006.01) |
| ***E21B 33/127*** | (2006.01) |
| ***E21B 33/129*** | (2006.01) |
| ***E21B 34/06*** | (2006.01) |
| ***E21B 43/08*** | (2006.01) |
| ***E21B 21/10*** | (2006.01) |
| *E21B 34/00* | (2006.01) |

(52) U.S. Cl.

CPC ..... *E21B 21/103* (2013.01); *E21B 33/12* (2013.01); *E21B 33/127* (2013.01); *E21B 33/129* (2013.01); *E21B 34/06* (2013.01); *E21B 43/08* (2013.01); *E21B 2034/007* (2013.01)

(58) Field of Classification Search

None

See application file for complete search history.

(56) References Cited

U.S. PATENT DOCUMENTS 3,850,246 A 11/1974 Despujols
4,312,415 A * 1/1982 Franks, Jr. ..... E21B 17/18 137/625.31
4,373,582 A 2/1983 Bednar et al.
7,204,327 B2 4/2007 Livingstone
8,240,397 B2 * 8/2012 Crawford ..... E21B 7/068 175/100

(Continued)

FOREIGN PATENT DOCUMENTS

| | | |
|---|---|---|
| WO | 2004/013461 | 2/2004 |
| WO | 2014/067590 | 5/2014 |

OTHER PUBLICATIONS

International Search Report and Written Opinion of the International Searching Authority issued in International Application No. PCT/US2016/064427 dated May 26, 2017; 16 pages.

*Primary Examiner* — Matthew R Buck

*Assistant Examiner* — Douglas S Wood

(74) *Attorney, Agent, or Firm* — Fish & Richardson P.C.

(57) ABSTRACT

A crossover sub includes a tubular housing connected to a drill string in a wellbore, a sealing structure to seal against a wellbore wall, and a sleeve valve disposed within the housing and movable between a closed position and an open position in response to a fluid pressure in a first flow chamber or second, separate flow chamber of the housing. The first flow chamber fluidly connects an upper annulus of the wellbore to a central bore of the drill string downhole of the crossover sub. The second flow chamber fluidly connects a central bore of the drill string uphole of the sealing structure to a lower annulus of the wellbore. The sleeve valve closes the second flow chamber in response to the sleeve valve being in the closed position, and opens the second flow chamber in response to the sleeve valve being in the open position.

13 Claims, 6 Drawing Sheets

(56) References Cited

U.S. PATENT DOCUMENTS

| | | | | |
|---|---|---|---|---|
| 8,833,490 | B2 | 9/2014 | Johnson | |
| 8,973,681 | B2 | 3/2015 | Aros | |
| 10,174,602 | B2 * | 1/2019 | Maxey | E21B 43/14 |
| 2006/0243440 | A1 | 11/2006 | Corbett et al. | |
| 2011/0048723 | A1 | 3/2011 | Edwards | |
| 2013/0133953 | A1 | 5/2013 | Burca et al. | |
| 2013/0133956 | A1 | 5/2013 | Jones et al. | |

* cited by examiner

REVERSE CIRCULATION WELL TOOL

TECHNICAL FIELD

This disclosure relates to reverse circulation well tools, and more particularly to well flow crossover subs on a drill string.

BACKGROUND

Circulation systems are used in well tools during well drilling operations to supply drilling fluid, or mud, to a drill bit at a bottom-hole end of a drill string. Conventional circulation systems include pumping drilling fluid through a central bore of a drill string to a drill bit, for example, to assist cooling the drill bit, flush wellbore cuttings away from the bit-rock interface, and lift the drilling fluid that carries the cuttings uphole through the annulus between the drill string and walls of the wellbore. Some circulation systems employ a circulation well tool, for example, one that includes a dropped-ball-activated sleeve valve to divert fluid flow from the central bore of a drill string to the annulus of the wellbore downhole of the sleeve valve.

SUMMARY

This disclosure describes reverse circulation well tools, for example, well flow crossover subs of a drill string.

In some aspects, a well flow crossover sub includes a substantially tubular housing configured to be part of a drill string and disposed in a wellbore, the substantially tubular housing including a first flow chamber and a second, separate flow chamber. The crossover sub includes a sealing structure circumscribing a portion of the substantially tubular housing and including a sealing element, the sealing element configured to seal against a wellbore wall of the wellbore, and a sleeve valve disposed within the substantially tubular housing and selectively movable between a first, closed position and a second, open position in response to a fluid pressure in the first flow chamber or second flow chamber. The first flow chamber fluidly connects an annulus of the wellbore uphole of the sealing structure to a central bore of the drill string downhole of the well flow crossover sub, the first flow chamber extending between a first radial port opening at the annulus of the wellbore uphole of the sealing structure proximate a first longitudinal end of the substantially tubular housing and a downhole central bore in the substantially tubular housing at a second, opposite longitudinal end of the substantially tubular housing. The second flow chamber fluidly connects a central bore of the drill string uphole of the sealing structure to the annulus of the wellbore downhole of the sealing structure, the second flow chamber extending between an uphole central bore in the substantially tubular housing at the first longitudinal end and a second radial port opening at the annulus of the wellbore downhole of the sealing structure proximate the second longitudinal end of the substantially tubular housing. The sleeve valve is configured to close the second radial port opening in response to the sleeve valve being in the first, closed position and to open the second radial port opening in response to the sleeve valve being in the second, open position.

This, and other aspects, can include one or more of the following features. The sleeve valve can include a passage through a wall of the sleeve valve, and the passage can be alignable with the second radial port opening when the sleeve valve is in the second, open position. The tubular housing can include a fluid pressure chamber fluidly coupled to the first flow chamber by a flow port, and the sleeve valve can contact a fluid in an interior of the fluid pressure chamber, where the sleeve valve is configured to move in response to hydraulic pressure of the fluid in the fluid pressure chamber acting on the sleeve valve. The well flow crossover sub can include a biasing element between the sleeve valve and the tubular housing to bias the sleeve valve toward the first, closed position, where the sleeve valve is configured to move toward the second, open position in response to a hydraulic pressure of the fluid in the fluid pressure chamber greater than a threshold hydraulic pressure, the threshold hydraulic pressure corresponding to a biasing force acting on the sleeve valve from the biasing element. The flow port can include at least one of a sand-screen or filter. The well flow crossover sub can include a piston assembly disposed within a piston chamber of the tubular housing, the piston assembly including a piston and a piston pin extending toward the sleeve valve. A fluid inlet port can fluidly couple the piston chamber to the uphole central bore at the first longitudinal end of the tubular housing, and the piston assembly can be configured to contact and move the sleeve valve toward the second, open position in response to hydraulic pressure of fluid in the piston chamber acting on the piston assembly. The piston pin can contact the sleeve valve to move the sleeve valve to the second, open position in response to hydraulic pressure of fluid in the piston chamber acting on a surface of the piston. The well flow crossover sub can include a biasing element between a surface of the housing and the piston assembly to bias the piston assembly in a direction opposite the hydraulic pressure of fluid in the piston chamber acting on the piston assembly. The well flow crossover sub can include a pressure-activated disk valve disposed in the fluid inlet port, the disk valve configured to selectively open the fluid inlet port in response to a hydraulic pressure in the uphole central bore at the first longitudinal end of the tubular housing greater than a threshold hydraulic pressure. The sealing element can include an inflatable packer, and the sealing structure can include an activation chamber fluidly connected to the fluid pressure chamber by an activation flow port. The sleeve valve can be configured to close the activation flow port in response to the sleeve valve being in the first, closed position and to open the activation flow port to the fluid pressure chamber in response to the sleeve valve being in the second, open position. The sealing structure can couple to the substantially tubular housing with a ball bearing. The sealing element can include a packer element, and the packer element can include a mechanical packer or an inflatable packer.

Certain aspects encompass a method including receiving, in a first flow chamber of a well crossover sub of a drill string disposed in a wellbore, a fluid pressure greater than a threshold fluid pressure from a fluid in an annulus of the wellbore, the fluid pressure acting on a sleeve valve of the well crossover sub. The well crossover sub includes a substantially tubular housing including the first flow chamber and a second flow chamber, the sleeve valve, and a sealing structure circumscribing a portion of the substantially tubular housing, where the first flow chamber fluidly connects the annulus of the wellbore uphole of the sealing structure to a central bore of the drill string downhole of the well flow crossover sub, and where the second flow chamber fluidly connects a central bore of the drill string uphole of the sealing structure to the annulus of the wellbore downhole of the sealing structure. The method includes moving, in response to receiving the fluid pressure greater than the threshold fluid pressure, the sleeve valve from a first, closed position restricting fluid flow through the second flow chamber to a second, open position allowing fluid flow through the second flow chamber. The method further includes flowing a first fluid from the annulus uphole of the sealing structure to the central bore of the drill string downhole of the well crossover sub through the first flow chamber, and flowing a second fluid from the annulus downhole of the sealing structure to the central bore of the drill string uphole of the sealing structure through the second flow chamber.

This, and other aspects, can include one or more of the following features. The first flow chamber can extend between a first radial port opening proximate a first longitudinal end of the substantially tubular housing and a downhole central bore of the tubular housing at a second, opposite longitudinal end of the substantially tubular housing, and the second flow chamber can extend between an uphole central bore of the substantially tubular housing at the first longitudinal end and a second radial port opening proximate the second longitudinal end of the substantially tubular housing. Moving the sleeve valve from the first, closed position to the second, open position can include opening the second radial port opening of the second flow chamber to allow fluid flow through the second flow chamber. The sealing structure can include a packer element, and the method can include setting the packer element in response to movement of the sleeve valve to the second, open position. Setting the packer element can include substantially sealing the packer element against a wellbore wall, the set packer element being positioned between the first radial opening at the first longitudinal end of the well crossover sub and the second radial opening at the second longitudinal end of the well crossover sub. The method can further include receiving a fluid pressure in the first flow chamber less than the threshold fluid pressure, and returning the sleeve valve to the first, closed position to restrict fluid flow through the second radial open opening. Returning the sleeve valve to the first, closed position can include biasing the sleeve valve toward the first, closed position with a biasing spring, where a spring force of the biasing spring acting on the sleeve valve is substantially equal to the threshold fluid pressure. The method can further include receiving a second fluid pressure in the second flow chamber greater than a second threshold fluid pressure, moving, in response to receiving the second fluid pressure, a piston assembly in a piston chamber fluidly coupled to the first flow chamber, where the piston assembly includes a piston and a piston pin extending toward the sleeve valve, and moving the sleeve valve to the second, open position in response to movement the piston assembly with the piston assembly engaged with the sleeve valve.

In some aspects of the disclosure, a well tool includes a substantially tubular housing configured to be part of a drill string and disposed in a wellbore, the substantially tubular housing including a first flow chamber and a second, separate flow chamber. The well tool includes a sleeve valve disposed within the substantially tubular housing and selectively movable between a first, closed position and a second, open position in response to a fluid pressure in the first flow chamber or the second flow chamber. The first flow chamber fluidly connects an annulus of the wellbore uphole of the well tool to a central bore of the drill string downhole of the well tool, the first flow chamber extending between a first plurality of radial port openings proximate a first longitudinal end of the substantially tubular housing and a downhole central bore of the substantially tubular housing at a second, opposite longitudinal end of the substantially tubular housing. The second flow chamber fluidly connects a central bore of the drill string uphole of the well tool to the annulus of the wellbore downhole of the well tool, the second flow chamber extending between an uphole central bore in the substantially tubular housing at the first longitudinal end and a second plurality of radial port openings proximate the second longitudinal end of the substantially tubular housing. The sleeve valve is configured to close the second radial port opening when the sleeve valve is in the first, closed position and to open the second radial port opening when the sleeve valve is in the second, open position.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
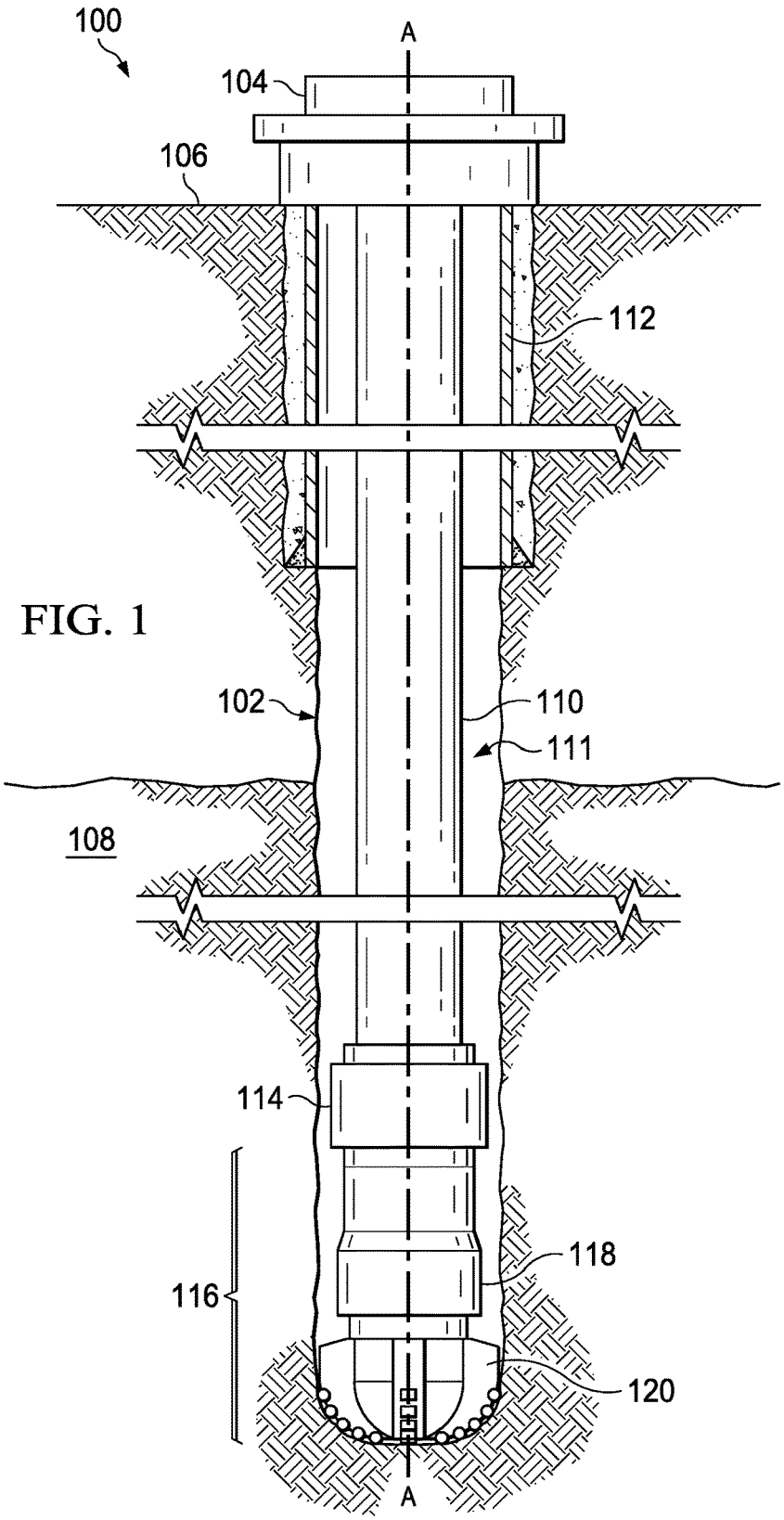
FIG. 1 is a schematic partial cross-sectional view of an example well drilling system.

This disclosure describes a well tool configured to be disposed on (for example, integral to) a drill string in a wellbore. The well tool selectively opens and closes reverse circulation flow chambers, or flow pathways, that fluidly connect the annulus of the wellbore with a central bore of a drill string. The flow chambers divert fluid flow between the annulus and a segmented central bore of the drill string. The segmented central bore, for example, can be separated into an uphole central bore portion and a downhole central bore portion with respect to the well tool.

Well tools, as disclosed herein, can be disposed in the wellbore as part of (for example, integral to, formed in, or coupled to) the drill string. For example, the well tool can include a flow crossover sub connected on a first, uphole end and a second, downhole end to the drill string, and the flow crossover sub can include two or more flow chambers. A first flow chamber fluidly connects the wellbore annulus uphole of the crossover sub to the central bore of the drill string downhole of the crossover sub (for example, a central bore of a drill bit). A second flow chamber fluidly connects the wellbore annulus downhole of the crossover sub with the central bore of the drill string uphole of the crossover sub. With the well tool or crossover sub disposed in the wellbore, one or more of the flow chambers can be selectively controlled to allow the flow of fluid (for example, drilling fluid, mud, well kill fluid, or other fluid) through one or more of the flow chambers. Selective control can include selectively opening or closing flow ports of the flow chambers. For example, a fluid flow from within the annulus of the wellbore downhole of the well tool to the central bore of the drill string uphole of the well tool can be selectively closed to flow or opened to flow. The opening and closing of the flow ports of the flow chambers can be controlled in response to fluid pressure within the well tool, such as hydraulic pressure within the first flow chamber, the second flow chamber, or both the first flow chamber or second flow chamber. In some implementations, hydraulic pressure is applied to the annulus, the central bore, or both, and thereby to the first flow chamber, second flow chamber, or both, from surface equipment at a surface of the wellbore. The surface equipment can include, for example, a well head, a rotating control device (RCD), a top drive, fluid pumps, a combination of these, or other equipment and devices.

In some well circulation systems, a central bore of a drill string delivers drilling fluid from a well surface to a drill bit at a downhole end of the drill string in a wellbore. Used drilling mud with formation cuttings is lifted uphole through the annulus to the well surface. In instances of circulation loss events, such as fluid loss, some conventional circulation systems employ a drop-ball plug that requires a ball to be dropped down the drill string central bore to seat with and activate a sliding sleeve. Activating the sliding sleeve that open flow ports in the drill string and diverts flow from the drill string central bore to the annulus. For example, the sliding sleeve of conventional well circulation systems can open a flow port that allows for administration of fluid loss treatment (including coarse and heavy concentration LCM) from within the drill string to the fluid loss site in the annulus, bypassing the bottom hole assembly (BHA) to primarily avoid the plugging risk because of coarse material. In the event of well kick or formation fluid influx, conventional circulation systems generally require at least one bottom up circulation to remove the kick from the wellbore, and also takes a relatively long time to achieve that during well control process. Another potential high risk is that if the well kick is a large volume high pressure gas, when it is circulated out of hole, as it travels uphole in the annulus, it imposes a high pressure against any weak formation below the existing casing shoe, which may break the weak formation and create a situation called 'downhole internal blowout' that is extremely difficult to cure and may lead to well abandonment. In the event of a well encountering total losses while drilling, if unable to cure or regain any return, conventional circulating system will incur very substantial mud losses because of required mud cap on the backside (i.e., filling hole in the annulus with mud continuously for avoiding hydrostatic pressure loss and well control situation) and pumping drilling fluid at required rate through drill string for normal drilling and hole cleaning purpose. In an attempt to cure a loss of circulation problem, current practice often involves deploying a circulation tool installed above a drilling BHA, such as commonly used PBL sub, operated by dropping small balls for opening and closing a sleeve valve. This kind of sub can allow pumping heavy concentration LCM pills that by-pass drilling BHA for avoiding plugging. The diverted LCM pills from this tool into the annulus travel either downhole or uphole, at least some portion of LCM pills will end up in loss zone. This kind of tool used for dealing with loss of circulation has shown to have a positive effect for curing mud losses in the field. However, due to a restricted flow through area of the tool once a ball resides in its catcher seat, continued drilling would be somewhat hindered by a limited flow rate (less hydraulic horsepower) for the drilling BHA below. There is a need for alternative technique to address the common challenges listed above encountered during drilling operations. This disclosure describes reverse circulation well systems, for example, where the annulus delivers drilling fluid to a well flow crossover sub and other downhole tools at a downhole location on a drill string, and used drilling mud with formation cuttings is lifted uphole through the central bore of the drill string uphole of the flow crossover sub. For example, the downhole tools can include mud motors, drill bits, or other tools. Also, the well crossover sub includes a sleeve valve that selectively opens and closes a crossover flow chamber in the well crossover sub to allow, restrict, close, or otherwise control fluid flow in a wellbore.

Well tools that can selectively open and close reverse circulation flow ports and flow chambers, as disclosed herein, allow for monitoring and directed controlling of circulation flows. For example, well tools with the flow crossover sub as described herein can reduce, resolve, or counter drilling problems, such as well kick, formation fluid influx, wellbore fluid loss, or other events in a wellbore. In some implementations, a well drilling system with the flow crossover sub offers better drill cutting removal and a cleaner wellbore because of the reverse circulation drilling mode. In addition, the flow crossover sub allows for lower surface pump pressure requirements and lower pump rate for circulation while drilling than standard or normal circulation drilling. In some implementations, the well flow crossover sub can act as a downhole barrier to fluid flow, as a float when pumps are off, or both. For example, the well flow crossover sub can act as a physical barrier to fluid flow, as a float when no fluid flow is being pumped into or out of the wellbore or both, for example, when the sleeve valve is in a closed position to restrict fluid flow in the wellbore. In certain implementations, the flow crossover sub operates as a reverse circulation sub that diverts drilling fluid from the annulus above the sub into the drill string to provide a sufficient hydraulic power for drill bit operation and hole cleaning at a bottom hole location of the wellbore. The flow crossover sub allows for drilling with lighter mud or a balanced mud weight, for example, as compared to conventional circulation well systems. Also, the flow crossover sub offers the ability to control and kill the well, for example, in the case of unplanned formation fluid influx, and circulate out kick faster and with little risk of exposing potential high pressure gas kick to any weak formation below the casing shoe. In some implementations, a well drilling system with the flow crossover sub offers better ability to effectively deal with severe loss circulation problems. Further, the flow crossover sub also allows for fluid to be pumped down the drill string. For example, the flow crossover sub allows for injection of well kill fluid, heavy loss circulation material (LCM), or both, through the drill string to deliver to a target zone in a wellbore. In some instances, the well flow crossover sub can be integrated with standard oilfield drill strings and downhole bottom hole assemblies (BHAs) for reverse circulation drilling applications.

FIG. 1 is a schematic partial cross-sectional view of an example well drilling system 100 that includes a substantially cylindrical wellbore 102 extending from a well head 104 at a surface 106 downward into the Earth into one or more subterranean zones of interest 108 (one shown). The well system 100 includes a vertical well, with the wellbore 102 extending substantially vertically from the surface 106 to the subterranean zone 108. The concepts herein, however, are applicable to many other different configurations of wells, including horizontal, slanted, or otherwise deviated wells. A drill string 110 is shown as having been lowered from the surface 106 into the wellbore 102. In certain instances, after some or all of the wellbore 102 is drilled, a portion of the wellbore 102 is lined with lengths of tubing, called casing 112. The casing 112 can include a series of jointed lengths of tubing coupled together end-to-end or a continuous (for example, not jointed) coiled tubing. In the example well system 100 of FIG. 1, the drill string 110 includes a reverse circulation well tool 114 (for example, a flow crossover sub) and a bottom hole assembly (BHA) 116 disposed within, or as part of, the drill string 110 at a downhole end of the drill string 110. The reverse circulation well tool 114 selectively circulates fluid between the annulus 111 of the wellbore and a central bore (not shown) of the drill string 110.

In the example well system 100 of FIG. 1, the BHA 116 can includes a mud motor or drill collars 118 and a drill bit 120. In some instances, the BHA 116 can include additional or different components. The well system 100 of FIG. 1 depicts a well being drilled by the drill bit 120 on the drill string 110. However, the well system 100 can include another type of well string during another stage of well operation. For example, the well system can include a production well, a well being tested, or a well during other well operations, and can include a production string, testing string, or other type of well string that incorporates the reverse circulation well tool 114. The well system 100 of FIG. 1 also shows the reverse circulation well tool 114 as directly above the mud motor or drill collars 118 of the BHA 116. However, the reverse circulation well tool 114 can be disposed at a different location on the drill string 110, for example, based on a drilling mode, an expected location of a circulation loss event, or both. In some examples, a circulation loss event can include a fluid loss zone, formation fluid influx, casing damage, a combination of these, or other events. In some examples, the reverse circulation well tool 114 is disposed directly above (for example, directly uphole of) the drill bit 120, or disposed separate from and farther uphole of the BHA 116 than that shown in FIG. 1, such as within the casing 112. In some implementations, the drill string can include a measurement while drilling (MWD) tool (not shown, but with a full bore pass-through, installed above the well tool 114) for real-time downhole data transmission.

Figure 2:
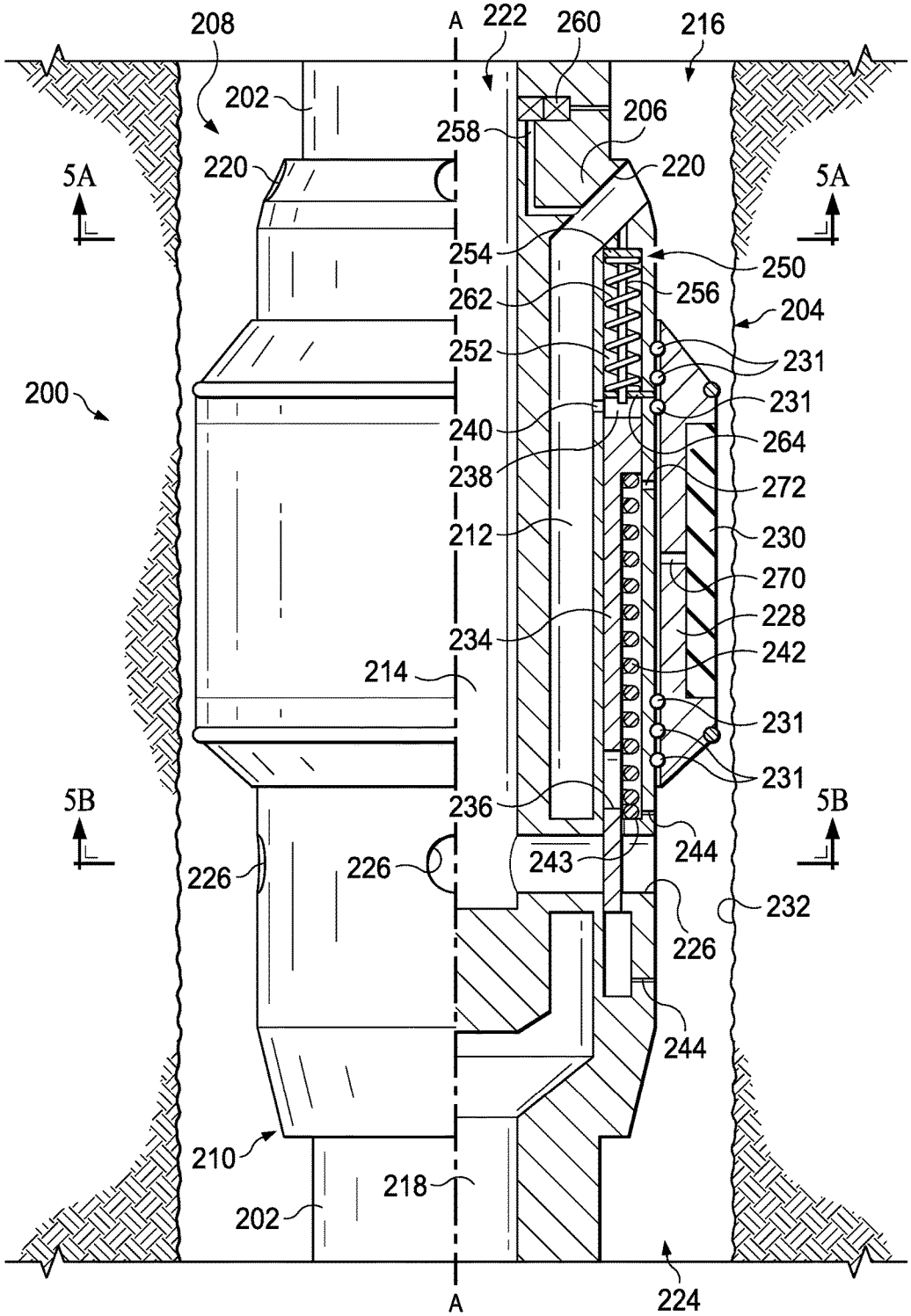
FIG. 2 is a schematic partial cross-sectional view of an example well flow crossover sub in a wellbore.

FIG. 2 is a schematic partial cross-sectional view of an example well flow crossover sub 200. The well flow crossover sub 200 can be used in the reverse circulation well tool 114 of the example well system 100 of FIG. 1. The example flow crossover sub 200 of FIG. 2 is shown disposed on a drill string 202 (such as drill string 110 of FIG. 1) and within a wellbore 204 (such as wellbore 102 of FIG. 1) substantially along longitudinal axis A-A. The crossover sub 200 includes a substantially tubular housing 206 extending between a first, longitudinally uphole end 208 and a second, longitudinally downhole end 210 of the crossover sub 200 with respect to the wellbore 204. The tubular housing 206 includes a first flow chamber 212 and a second flow chamber 214 separate from the first flow chamber 212.

The first flow chamber 212 defines a flow pathway that fluidly connects an upper annulus 216 of the wellbore 204 to a downhole central bore 218 of the crossover sub 200. The upper annulus 216 correlates to the annulus of the wellbore 204 uphole of the crossover sub 200. The downhole central bore 218 of the crossover sub 200 fluidly connects to, for example, the central bore of the portion of the drill string 202 downhole of the crossover sub 200, a central bore of a bottom hole assembly, or a central bore of a drill bit on the drill string 202. In the example crossover sub 200 of FIG. 2, the first flow chamber 212 extends between a first radial port opening 220 in the housing 206 proximate the first, longitudinally uphole end 208 of the housing 206 and the downhole central bore 218 proximate the second, longitudinally downhole end 210 of the housing 206. The first radial port opening 220 opens to the upper annulus 216.

The second flow chamber 214 defines a flow pathway that fluidly connects an uphole central bore 222 of the crossover sub 200 to a lower annulus 224 of the wellbore 204. The lower annulus 224 correlates to the annulus of the wellbore 204 downhole of the crossover sub 200. In the example crossover sub 200 of FIG. 2, the second flow chamber 214 extends between the uphole central bore 222 at the first, longitudinally uphole end 208 of the housing 206 and a second radial port opening 226 proximate the second, longitudinally downhole end 210 of the housing 206. The second radial port opening 226 opens to the lower annulus 224. The first flow chamber 212 and the second flow chamber 214 bypass each other between the first longitudinally uphole end and the second, longitudinally downhole end of the crossover sub 200, and do not fluidly connect with each other within the housing 206.

The example flow crossover sub 200 also includes a substantially tubular sealing structure 228 circumscribing at least a portion of the housing 206. A radially inner surface of the sealing structure 228 substantially seals with a radially outer surface of the housing 206, with respect to longitudinal axis A-A. The sealing structure 228 includes a sealing element 230 at a radially outer surface of the sealing structure 228, where the sealing element 230 is configured to seal (substantially or completely) against inner wellbore walls 232 of the wellbore 204 when activated. In some examples, the sealing element 230 maintains a substantial seal against the inner wellbore walls 232 during longitudinal movement of the sealing structure 228 along the longitudinal axis A-A, for example, during drilling of the wellbore. The sealing element 230, when engaged against the inner wellbore walls 232 of the wellbore 204, separates the annulus of the wellbore 204 into the upper annulus 216 uphole of the sealing element 230 and the lower annulus 224 downhole of the sealing element 230. In the example crossover sub 200 of FIG. 2, the sealing element 230 includes an inflatable packer element. In some implementations, the sealing element 230 is different. For example, the sealing element 230 can include a mechanical packer, an inflatable packer, or another type of packer element to seal against the inner wellbore walls 232.

In the example crossover sub 200 of FIG. 2, the sealing structure 228 couples to the tubular housing 206 with ball bearings 231. The ball bearings 231 allow the tubular housing 206 to rotate relative to sealing structure 228 during operation, for example, during drilling of the wellbore. The sealing structure 228 can remain non-rotational when the sealing element 230 engages the inner wellbore walls 232 while allowing the tubular housing 206 to rotate, for example, about longitudinal axis A-A. In some implementations, the sealing structure 228 couples to the tubular housing 206 in other ways. For example, the sealing structure 228 can be integral to the tubular housing 206, fixed to the tubular housing 206 with fasteners, or otherwise coupled to the tubular housing 206.

A sleeve valve 234 disposed within the housing 206 is selectively movable between a first, closed position and a second, open position in response to a fluid pressure in one or both of the first flow chamber 212 or the second flow chamber 214. The sleeve valve 234 restricts fluid flow through the second flow chamber 214 when in the closed position, and allows fluid flow through the second flow chamber 214 when in the second, open position. For example, the sleeve valve 234 closes the second radial port opening 226 of the second flow chamber 214 in response to being in the first, closed position, whereas the sleeve valve 234 opens the second radial port opening 226 in response to being in the second, open position. FIG. 2 shows the sleeve valve 234 in the first, closed position, blocking fluid flow through the second flow chamber 214 proximate the second radial port opening 226. For example, fluid in the upper annulus 216 can flow through the first flow chamber 212 and into the downhole central bore 218. However, in this first, closed position of the sleeve valve 234, fluid is restricted from flowing through the second flow chamber between the uphole central bore 222 and the lower annulus 224.

Figure 3:
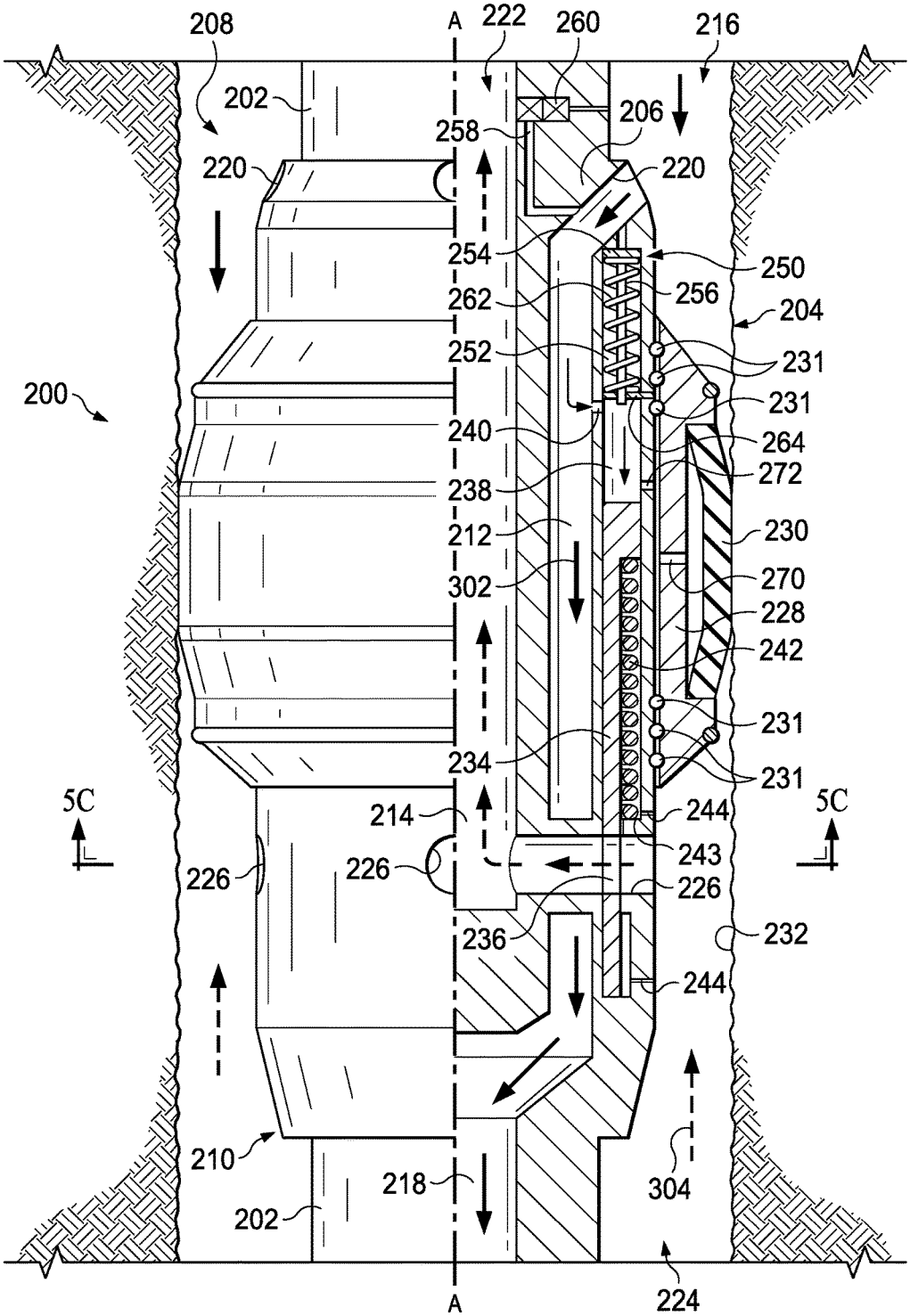
FIG. 3 is a schematic partial cross-sectional view of an example well flow crossover sub in a wellbore.

FIG. 3 is a schematic partial cross-sectional view of the example well flow crossover sub 200 of FIG. 2, where FIG. 3 depicts the sleeve valve 234 in the second, open position. FIG. 3 also depicts the sealing structure 228 in a set position with the sealing element 230 engaged with the inner wellbore walls 232 of the wellbore 204. The example sleeve valve 234 includes a substantially cylindrical sleeve with a passage 236 in the walls of the cylindrical sleeve that aligns with the second radial port opening 226 when the sleeve valve 234 is in the second, open position. The passage 236 can take a variety of forms, such as an opening or aperture in the wall of the cylindrical sleeve. In FIG. 2, the passage 236 does not align with the second radial port opening 226, and the walls of the cylindrical sleeve act as a flow barrier at the second radial port opening 226. In FIG. 3, the passage 236 aligns with the second radial port opening 226 and allows fluid to flow through the second flow chamber 214.

The sleeve valve 234 is disposed in part in a fluid pressure chamber 238 within the housing 206, where the fluid pressure chamber 238 is fluidly coupled to the first flow chamber 212 via flow port 240. In some implementations, the flow port 240 includes a sandscreen, filter, or both, for example, to reduce or prevent solids and particulates from entering the fluid pressure chamber 238. A downhole end of the sleeve valve 234 extends out of the fluid pressure chamber 238 and into the second flow chamber 214 about the second radial port opening 226. In some implementations, fluid in an interior of the fluid pressure chamber 238 contacts an uphole end of the sleeve valve 234, where the fluid enters from the first flow chamber 212 via flow port 240. The uphole end of the sleeve valve 234 seals with lateral interior sidewalls of the fluid pressure chamber 238 such that the fluid in the fluid pressure chamber 238 can apply a hydraulic pressure on the sleeve valve 234. In other words, the sleeve valve 234 receives the fluid pressure from the fluid in the upper annulus 216 via the first flow chamber 212 and the fluid pressure chamber 238. In some implementations, the sleeve valve 234 is configured to move between the first, closed position and the second, open position based at least in part on the hydraulic pressure from the fluid in the fluid pressure chamber 238 acting on the sleeve valve 234. For example, a fluid pressure in the first flow chamber 212 is applied to a surface of the sleeve valve 234 to selectively open or close the sleeve valve 234 based on the applied fluid pressure.

In some implementations, a biasing element 242 is positioned between the sleeve valve 234 and the housing 206 to bias the sleeve valve 234 toward the first, closed position. The biasing element 242 can take a variety of forms, such as a spring, an elastomeric element, or other. In the example crossover sub 200 of FIGS. 2 and 3, the biasing element 242 includes a spring positioned on one end against the sleeve valve 234 and on the other end against a shoulder 243 of the tubular housing 206 that defines an end of the fluid pressure chamber 238. The biasing element 242 (spring) applies a force (spring force) against a surface of the sleeve valve 234 in a direction toward the closed position of the sleeve valve 234. The force from the biasing element 242 corresponds to, is equivalent to, or establishes a threshold hydraulic pressure against the sleeve valve 234. This threshold hydraulic pressure correlates to the minimum hydraulic pressure required to overcome the biasing element 242 force acting on the sleeve valve 234. In some implementations, the housing 206 includes one or more pressure release vents 244 from the fluid pressure chamber 238, for example, to equalize or release pressure in the fluid pressure chamber 238 during movement of the sleeve valve 234.

Figure 6:
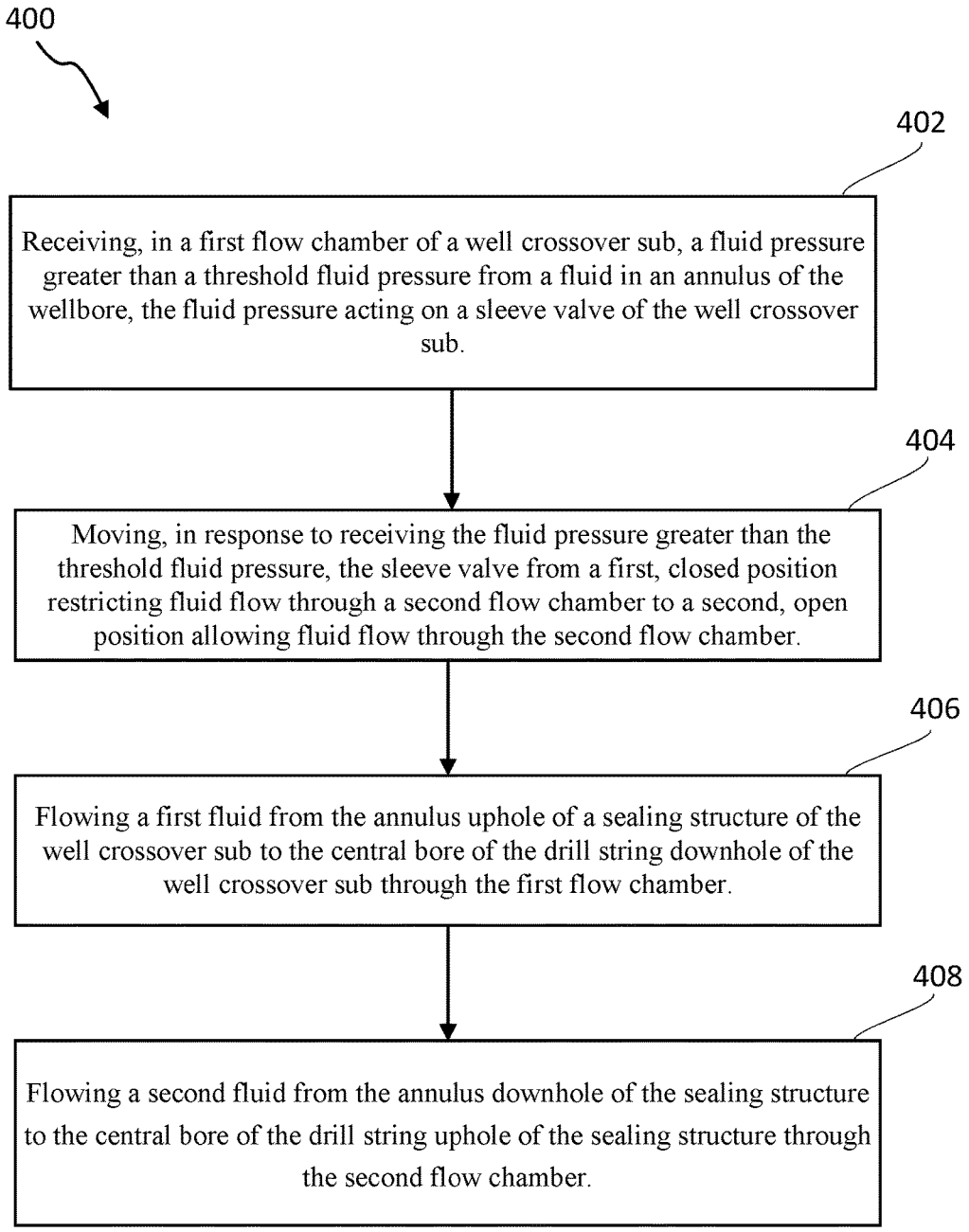
FIG. 6 is a flowchart describing an example method of flowing fluid through a well crossover sub.

FIG. 6 is a flowchart describing an example method 400 of flowing fluid through a well crossover sub, such as the well crossover sub 200 of FIG. 3. In some implementations, at 402, a fluid pressure greater than a threshold fluid pressure from a fluid in the annulus of the wellbore is received in a first flow chamber of a well crossover sub the fluid pressure acting on a sleeve valve of the well crossover sub. For example, as shown in the example crossover sub 200 of FIG. 3, fluid from the upper annulus 216 is received in the first flow chamber 212 and flows into the fluid pressure chamber 238, and fluid pressure of this fluid acts on the sleeve valve 234. At 404, in response to receiving the fluid pressure greater than the threshold pressure, the sleeve valve moves from a first, closed position restricting fluid flow through a second flow chamber to a second, open position allowing fluid flow through the second flow chamber. For example, as shown in FIG. 3, the sleeve valve 234 moves toward the second, open position in response to a fluid pressure from the fluid in the fluid pressure chamber 238 that is greater than the threshold hydraulic pressure corresponding to the biasing element 242 acting on the sleeve valve 234. For example, if fluid pressure from the fluid in the fluid pressure chamber 238 is greater than the threshold hydraulic pressure, then the fluid pressure overcomes the biasing force from biasing element 242 and moves the sleeve valve 234 toward the second, open position, as shown in FIG. 3.

In some implementations, at 406 of FIG. 6, a first fluid flows from the annulus uphole of a sealing structure of the well crossover sub to the central bore of the drill string downhole of the well crossover sub through the first flow chamber. Also, at 408, a second fluid flows from the annulus downhole of the sealing structure to the central bore of the drill string uphole of the sealing structure through the second flow chamber. For example, FIG. 3 includes solid arrows indicating a first fluid flow 302 through the first flow chamber 212, and dashed arrows indicating a second fluid flow 304 through the second flow chamber 214. In FIG. 3, the first fluid flow 302 flows into the fluid pressure chamber 238 to move and maintain the sleeve valve 234 in the second, open position. For example, the first fluid flow 302 applies a hydraulic pressure against the sleeve valve 234 greater than the threshold hydraulic pressure correlating to the force from the biasing spring 242. With the sleeve valve 234 in the second, open position, the second fluid flow 304 is opened to allow flow, for example, from the lower annulus 224 through the second flow chamber 214 and up through the uphole central bore 222, following along the dashed arrows.

In some implementations, such as shown in FIGS. 2 and 3, the sealing structure 228 includes an activation chamber 270 within the sealing structure 228 and fluidly connected to the fluid pressure chamber 238 by an activation flow port 272. The activation flow port 272 is substantially closed to fluid flow when the sleeve valve 234 is in the first, closed position (for example, FIG. 2), and is open to fluid flow from the fluid pressure chamber 238 when the sleeve valve 234 is in the second, open position (for example, FIG. 3). The sleeve valve 234 is configured to close the activation flow port 272 in response to the sleeve valve 234 being in the closed position, and open the activation flow port 272 to the fluid pressure chamber 238 in response to the sleeve valve 234 being in the open position. The activation flow port 272 allows fluid in the fluid pressure chamber 238 (for example, from the first flow chamber 212) to enter into the activation chamber 270 and activate the sealing structure 228. For example, referring to FIG. 3 where the sleeve valve 234 is in the second, open position, a portion of the first fluid flow 302 can flow into the activation chamber 270 of the sealing structure 228 via the activation flow port 272. In some implementations, fluid in the activation chamber 270 sets the sealing structure 228 into sealing engagement with the wellbore walls 232. In the example shown in FIG. 3, fluid in the activation chamber 270 activates the sealing element 230 to engage the sealing element 230 with the wellbore walls 232. For example, activating the sealing element 230 can include inflating the inflatable packer 230 of FIG. 3.

In some implementations, hydraulic pressure in the first flow chamber 212 is applied from surface equipment at a surface of the wellbore 204. At the surface, the surface equipment can pressure up the upper annulus 216 above the flow crossover sub 200 to hydraulically move the sleeve valve 234 from the first, closed position shown in FIG. 2 to the second, open position shown in FIG. 3. In addition, the hydraulic pressure in the upper annulus 216 can be reduced, for example, to less than the threshold hydraulic pressure, to return the sleeve valve 234 to the closed position and close the second flow chamber 214.

In some implementations, the example flow crossover sub 200 includes a piston assembly 250 disposed within a piston chamber 252 of the tubular housing 206. The piston assembly 250 is disposed within the housing 206 and longitudinally adjacent to the fluid pressure chamber 238 relative to longitudinal axis A-A. The piston assembly 250 is configured to move the sleeve valve 234 toward the second, open position in response to hydraulic pressure in the second flow chamber 214. For example, the piston assembly 250 can contact the uphole end of the sleeve valve 234 and move based on an applied pressure from fluid in the second flow chamber 214.

Figure 4:
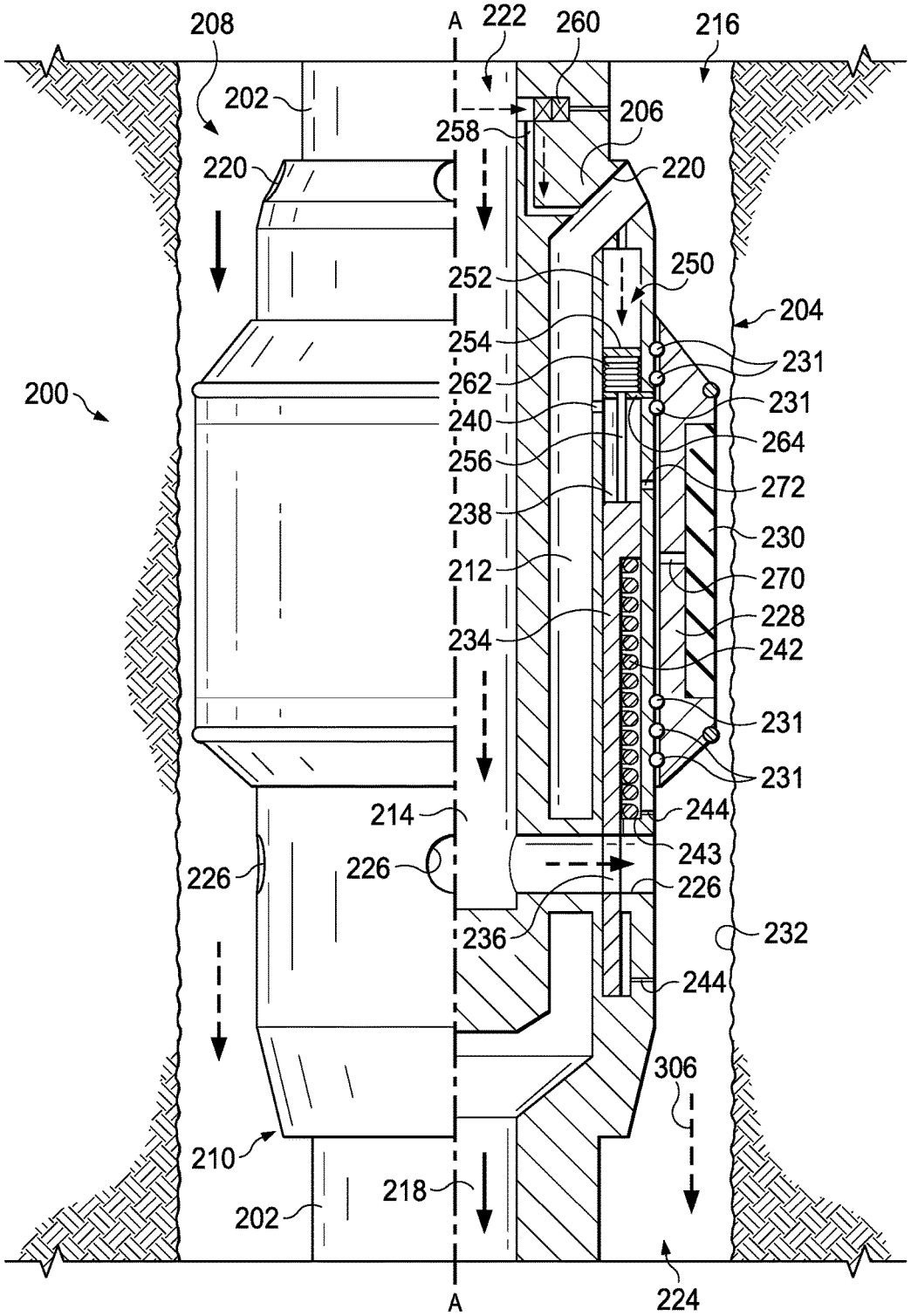
FIG. 4 is a schematic partial cross-sectional view of an example well flow crossover sub in a wellbore.

FIG. 4 is a schematic partial cross-sectional view of the example well flow crossover sub 200 of FIGS. 2 and 3, and shows the piston assembly 250 having moved the sleeve valve 234 to the second, open position. The piston assembly 250 includes a piston 254 that seals to interior side walls of the piston chamber 252 and a piston pin 256 that extends from the piston 254 toward the sleeve valve 234. In some examples, the piston pin 256 contacts the sleeve valve 234 to move the sleeve valve 234 toward the second, open position in response to hydraulic pressure of fluid in the piston chamber 252 acting on a surface of the piston 254. A fluid inlet port 258 fluidly couples the piston chamber 252 to the second flow chamber 214 at the uphole central bore 222.

In some implementations, the crossover sub 200 includes a pressure-activated disk valve 260 disposed in the fluid inlet port 258 to control fluid flow through the fluid inlet port 258. The disk valve 260 is configured to selectively open the fluid inlet port 258 to fluid in the second flow chamber 214 at the uphole central bore 222 at a hydraulic pressure greater than a threshold hydraulic pressure. For example, the pressure-activated disk valve 260 maintains the fluid inlet port 258 closed to flow until a threshold hydraulic pressure (for example, typically additional 1500 psi surface pump pressure) in the uphole central bore 222 is reached. At this threshold hydraulic pressure, the disk valve 260 opens the fluid inlet port 258 to allow fluid to pass along the fluid inlet port 258 and apply the hydraulic pressure on the piston assembly 250.

The example crossover sub 200 includes a biasing element 262 between a surface of the housing 206 and the piston assembly 250. The surface of the housing 206 can include a projection 264 of the housing 206. The biasing element 262 biases the piston assembly 250 in a direction opposite the hydraulic pressure of fluid in the piston chamber 252 acting on the piston assembly 250. The projection 264 in the housing 206 includes an aperture through which the piston pin 256 can pass through, for example, to allow the piston pin 256 to extend toward and contact the sleeve valve 234.

FIG. 4 includes dashed arrows indicating a third fluid flow 306 through the second flow chamber 214. In FIG. 4, the second flow chamber 214 is pressurized (for example, by surface equipment at a surface of the wellbore 204) to a pressure greater than the threshold hydraulic pressure of the pressure-activated disk valve 260. At this pressure threshold, the pressure-activated disk valve 260 opens, and the piston assembly 250 moves the sleeve valve 234 to the second, open position to allow fluid through the second flow chamber 214 from the uphole central bore 222 to the lower annulus 224. In other words, an applied pressure in the second flow chamber 214 can move the sleeve valve 234 to the second, open position. In some examples, pressurizing the second flow chamber 214 to move the sleeve valve 234 to the second, open position can counter a circulation loss event in the wellbore 204. For example, pressurizing both the first flow chamber 212 and the second flow chamber 214 to move the sleeve valve 234 to the second, open position can act to kill the well, isolate a zone of the wellbore downhole of the sealing structure 228, allow for pumping of lost-circulation material (LCM) in a fluid loss event downhole through the drill string and out to the wellbore annulus through the second flow chamber 214, or a combination of these.

FIGS. 2, 3, and 4 depict the crossover sub 200 as integral to the drill string 202 at the longitudinally uphole end 208 and longitudinally downhole end 210 of the crossover sub 200. However, the crossover sub 200 can couple to the drill string 202 in other ways. For example, the crossover sub can include a threaded pin end or threaded female end that engages with a corresponding threaded female end or threaded pin end of the drill string 202.

Figure 5A:
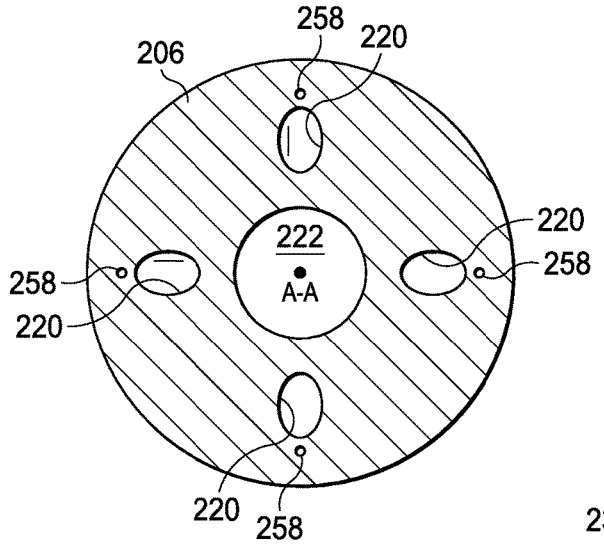
FIGS. 5A and 5B are schematic lateral cross-sectional views of the example well flow crossover sub of FIG. 2.
Figure 5B:
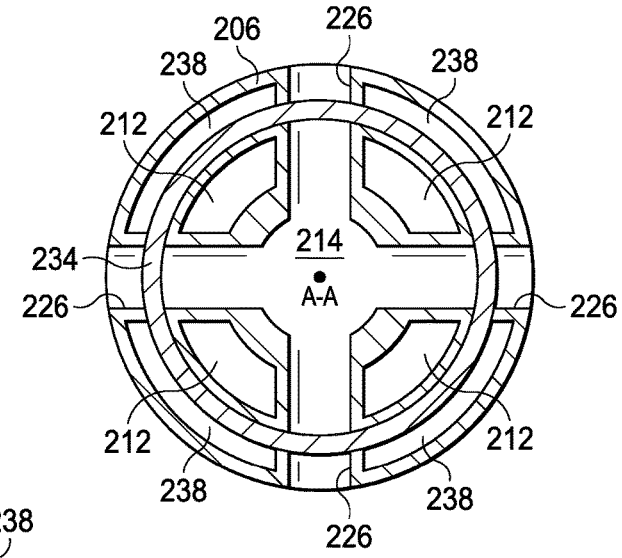
Figure 5C:
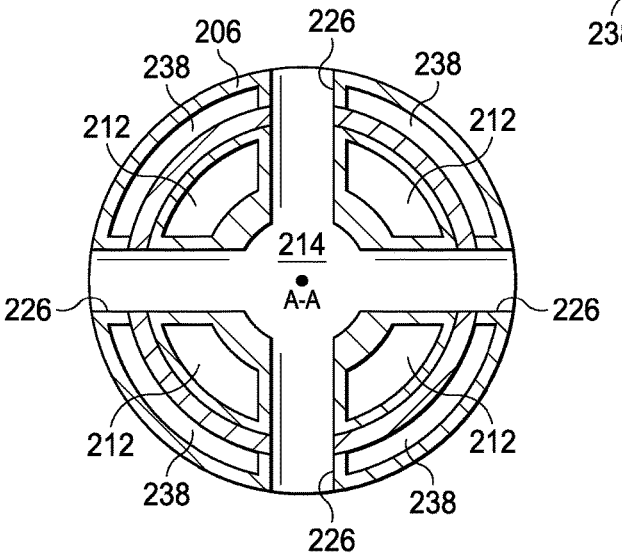
FIG. 5C is a schematic lateral cross-sectional view of the example well flow crossover sub of FIG. 3.

FIGS. 5A and 5B are a schematic lateral cross-sectional view of the example well flow crossover sub 200 of FIG. 2 along cut sections 5A-5A at the first radial port opening 220 and 5B-5B at the second radial port opening 226, respectively. FIG. 5A shows the first radial port opening 220 (four shown) radially disposed about the tubular housing 206 and the uphole central bore 222 of the crossover sub 200. Radially disposed can be defined as disposed, evenly or unevenly, about the circumference of the tubular housing 206, or about the central axis A-A. FIG. 5B shows the second radial port openings 226 (four shown), and the sleeve valve 234 in the first, closed position partially disposed in the second radial port openings 226. The sleeve valve 234 acts to block fluid flow from an exterior of the housing 206 through the second radial port opening 226 and into the uphole central bore 222. FIG. 5C is a schematic lateral cross-sectional view of the example crossover sub 200 along cut section 5C-5C of FIG. 3. FIG. 5C shows the second radial port openings 226 and the sleeve valve 234 in the second, open position. The passages 236 (four shown) in the sleeve valve 234 align with the second radial port openings 226, for example, allowing fluid flow from an exterior of the housing 206 through the second radial port openings 226 and into the uphole central bore 222.

A number of implementations have been described. Nevertheless, it will be understood that various modifications may be made without departing from the spirit and scope of the disclosure.

What is claimed is:

1. A well flow crossover sub comprising:

a substantially tubular housing configured to be part of a drill string and disposed in a wellbore, the substantially tubular housing comprising a first flow chamber and a second, separate flow chamber;

a sealing structure circumscribing a portion of the substantially tubular housing and comprising a sealing element, the sealing element configured to seal against a wellbore wall of the wellbore; and a sleeve valve disposed within the substantially tubular housing and selectively movable between a first, closed position and a second, open position in response to a fluid pressure in the first flow chamber or second flow chamber;

wherein the first flow chamber fluidly connects an annulus of the wellbore uphole of the sealing structure to a central bore of the drill string downhole of the well flow crossover sub, the first flow chamber extending between a first radial port opening at the annulus of the wellbore uphole of the sealing structure proximate a first longitudinal end of the substantially tubular housing and a downhole central bore in the substantially tubular housing at a second, opposite longitudinal end of the substantially tubular housing; and wherein the second flow chamber fluidly connects a central bore of the drill string uphole of the sealing structure to the annulus of the wellbore downhole of the sealing structure, the second flow chamber extending between an uphole central bore in the substantially tubular housing at the first longitudinal end and a second radial port opening at the annulus of the wellbore downhole of the sealing structure proximate the second longitudinal end of the substantially tubular housing; and the sleeve valve configured to close the second radial port opening in response to the sleeve valve being in the first, closed position and to open the second radial port opening in response to the sleeve valve being in the second, open position.

2. The well flow crossover sub of claim 1, wherein the sleeve valve comprises a passage through a wall of the sleeve valve, and wherein the passage is alignable with the second radial port opening when the sleeve valve is in the second, open position.

3. The well flow crossover sub of claim 1, wherein the tubular housing comprises a fluid pressure chamber fluidly coupled to the first flow chamber by a flow port, and the sleeve valve contacts a fluid in an interior of the fluid pressure chamber, the sleeve valve configured to move in response to hydraulic pressure of the fluid in the fluid pressure chamber acting on the sleeve valve.

4. The well flow crossover sub of claim 3, further comprising a biasing element between the sleeve valve and the tubular housing to bias the sleeve valve toward the first, closed position; and wherein the sleeve valve is configured to move toward the second, open position in response to a hydraulic pressure of the fluid in the fluid pressure chamber greater than a threshold hydraulic pressure, the threshold hydraulic pressure corresponding to a biasing force acting on the sleeve valve from the biasing element.

5. The well flow crossover sub of claim 3, wherein the flow port comprises at least one of a sandscreen or filter.

6. The well flow crossover sub of claim 3, further comprising a piston assembly disposed within a piston chamber of the tubular housing, the piston assembly comprising a piston and a piston pin extending toward the sleeve valve;

wherein a fluid inlet port fluidly couples the piston chamber to the uphole central bore at the first longitudinal end of the tubular housing; and wherein the piston assembly is configured to contact and move the sleeve valve toward the second, open position in response to hydraulic pressure of fluid in the piston chamber acting on the piston assembly.

7. The well flow crossover sub of claim 6, wherein the piston pin contacts the sleeve valve to move the sleeve valve to the second, open position in response to hydraulic pressure of fluid in the piston chamber acting on a surface of the piston.

8. The well flow crossover sub of claim 6, further comprising a biasing element between a surface of the housing and the piston assembly to bias the piston assembly in a direction opposite the hydraulic pressure of fluid in the piston chamber acting on the piston assembly.

9. The well flow crossover sub of claim 6, further comprising a pressure-activated disk valve disposed in the fluid inlet port, the disk valve configured to selectively open the fluid inlet port in response to a hydraulic pressure in the uphole central bore at the first longitudinal end of the tubular housing greater than a threshold hydraulic pressure.

10. The well flow crossover sub of claim 3, wherein the sealing element comprises an inflatable packer, and wherein the sealing structure comprises an activation chamber fluidly connected to the fluid pressure chamber by an activation flow port; and wherein the sleeve valve is configured to close the activation flow port in response to the sleeve valve being in the first, closed position and to open the activation flow port to the fluid pressure chamber in response to the sleeve valve being in the second, open position.

11. The well flow crossover sub of claim 1, wherein the sealing structure couples to the substantially tubular housing with a ball bearing.

12. The well flow crossover sub of claim 1, wherein the sealing element comprises a packer element.

13. The well flow crossover sub of claim 12, wherein the packer element comprises at least one of a mechanical packer or an inflatable packer.

* * * * *